US006715437B1

(12) United States Patent
Wilkins

(10) Patent No.: US 6,715,437 B1
(45) Date of Patent: Apr. 6, 2004

(54) LIQUID-CARGO LOSS DETECTION GAUGE

(75) Inventor: Larry C. Wilkins, Ft. Lauderdale, FL (US)

(73) Assignee: Electromechanical Research Laboratories, Inc., New Albany, IN (US)

( * ) Notice: Subject to any disclaimer, the term of this patent is extended or adjusted under 35 U.S.C. 154(b) by 0 days.

(21) Appl. No.: 10/350,630

(22) Filed: Jan. 24, 2003

Related U.S. Application Data

(60) Provisional application No. 60/430,437, filed on Dec. 3, 2002, and provisional application No. 60/352,690, filed on Jan. 29, 2002.

(51) Int. Cl.[7] ..... B63B 25/08
(52) U.S. Cl. ..... 114/74 R
(58) Field of Search ..... 114/74 R, 74 T, 114/74 A; 73/49.2

(56) References Cited

U.S. PATENT DOCUMENTS 5,412,978 A * 5/1995 Boone et al. ..... 73/49.2
5,668,308 A * 9/1997 Denby ..... 73/49.2
5,767,400 A * 6/1998 Nakano et al. ..... 73/152.46
5,900,546 A 5/1999 Wilkins
6,123,508 A 9/2000 Ching
6,323,441 B1 11/2001 Hager et al.
6,390,157 B1 5/2002 Moogdaharn et al.
6,412,344 B1 7/2002 Danicich et al.

* cited by examiner

*Primary Examiner*—Stephen Avila
(74) *Attorney, Agent, or Firm*—Woodard, Emhardt, Moriarty, McNett & Henry LLP

(57) ABSTRACT

Leakage detection of cargo from the hold of a barge involves a mounting plate to the top hatch of the hold. Two pipes secured to the plate extend to locations near the bottom. Each pipe has a guide tube in it coaxial with the pipe. Each pipe has a float in it received around the guide tube. A float follower is in each tube and magnetically coupled to the float so that the float follower rises and falls with the float. One pipe has an open bottom for cargo to freely move up and down in the pipe as the hold is filled and emptied. The other pipe has a valve at the bottom for admitting cargo from the hold to the pipe at the port of origin of the vessel. Following loading of the cargo, the valve is closed. One embodiment tethers the floats to reels atop the plate. Any change of level of the floats, reflecting a loss of cargo during transit from the port of origin to that of destination, is reflected in relative rotation of the reels and triggering an output signal to an annunciator. Another embodiment employs lasers transmitting to and receiving from the float followers, reporting to a comparator producing an output signal to an annunciator upon recognition of a difference between distances indicated by laser output signals. A third embodiment eliminates the guide tubes, floats and float followers.

42 Claims, 15 Drawing Sheets

LIQUID-CARGO LOSS DETECTION GAUGE

This application is based on provisional patent application Serial No. 60/430,437, filed Dec. 3, 2002, currently pending, which was based on provisional patent application Serial No. 60/352,690, filed Jan. 29, 2002, which is currently pending, and priority is claimed based on both applications.

BACKGROUND OF THE INVENTION

This invention relates generally to liquid cargo leaking, and more particularly to a system for reliable detection of loss of liquid cargo from the hold of a vessel.

BRIEF DESCRIPTION OF PRIOR ART

Leakage of liquid cargo from the hold of a vessel is obviously undesirable when viewed from waste, cost, safety and environmental considerations. Various arrangements have been used to determine the level of liquid in a cargo hold. With some of them, measurements could be taken periodically to determine whether or not there has been any loss of cargo. A different approach, useful in double-hull barges, is disclosed in my U.S. Pat. No. 6,216,623 issued Apr. 17, 2001.

One problem encountered in efforts to determine the existence and amount of cargo loss from liquid cargo holders and carriers, particularly in floating vessels, has been a change in temperature of the cargo between the times of measurement. This can undermine the significance of comparisons of measurements made at different times. The present invention is addressed to that problem.

DESCRIPTION OF THE ILLUSTRATED EMBODIMENTS

Figure 1:
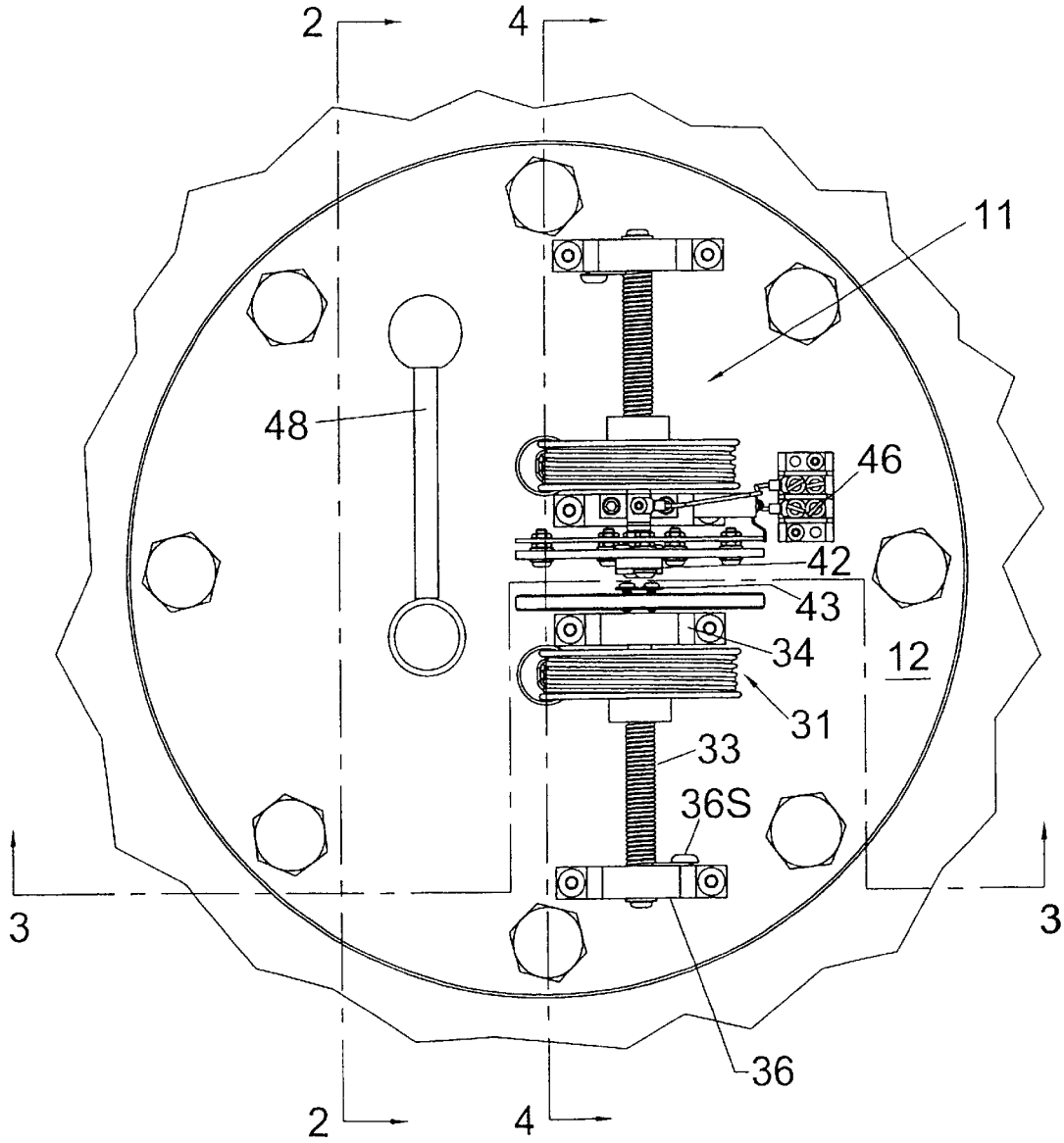
FIG. 1 is a top plan view of a hatch cover atop a cargo hold (shown fragmentarily) of a vessel and incorporating a typical embodiment of the present invention therein.
Figure 2:
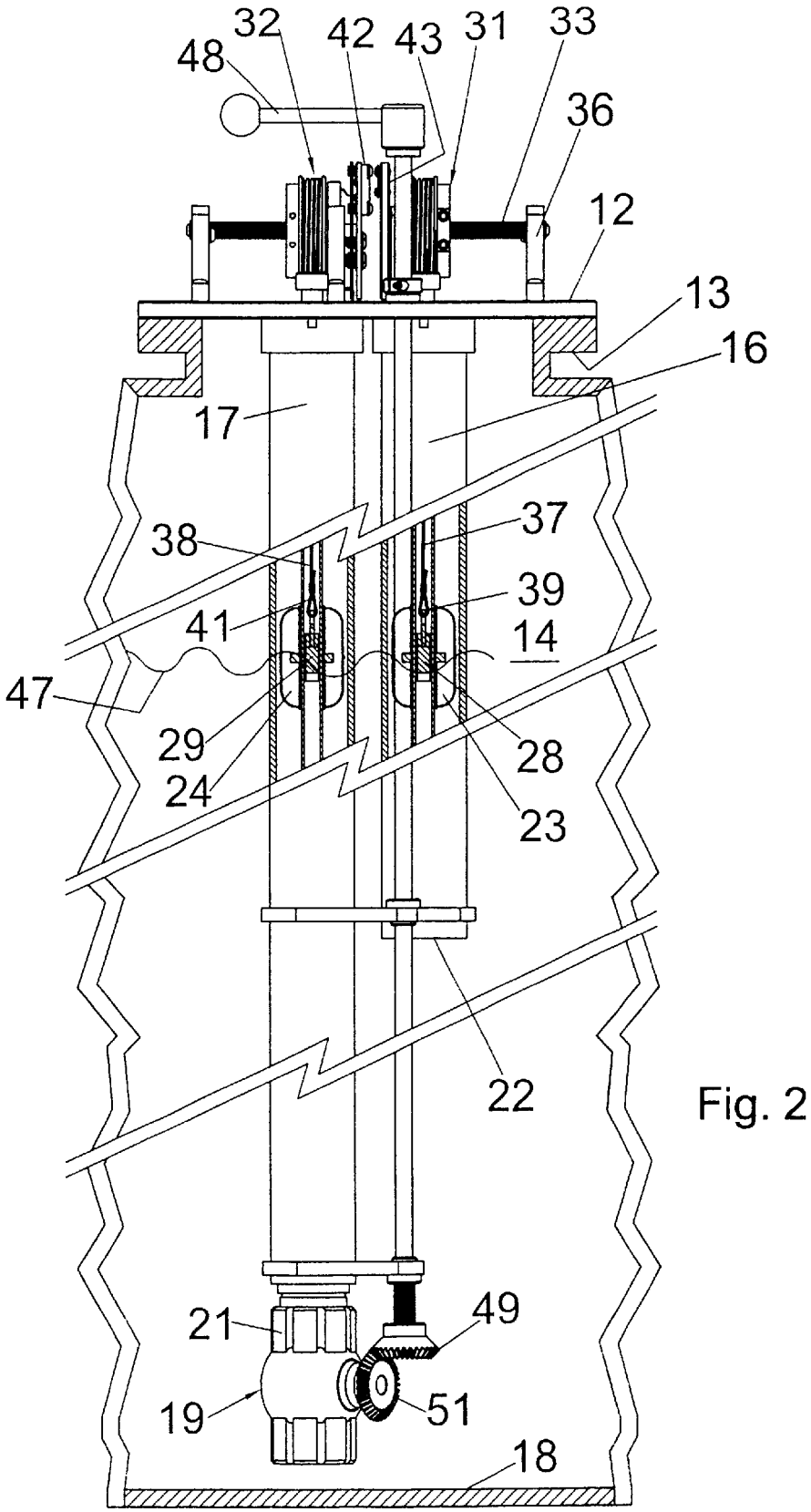
FIG. 2 is a vertical sectional view into the cargo hold, and taken at line 2—2 in FIG. 1 and viewed in the direction of the arrows.
Figure 3:
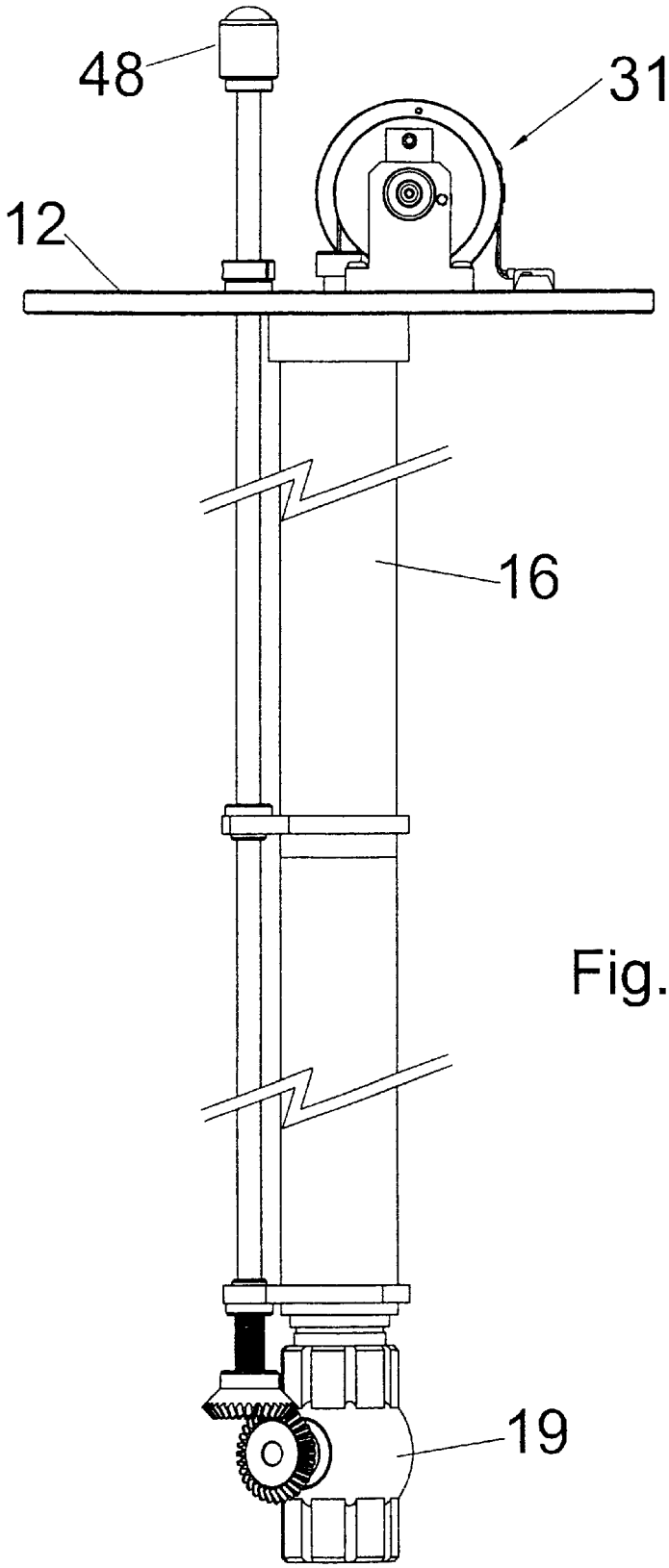
FIG. 3 is a section of the gauge assembly taken at line 3—3 in FIG. 1.
Figure 4:
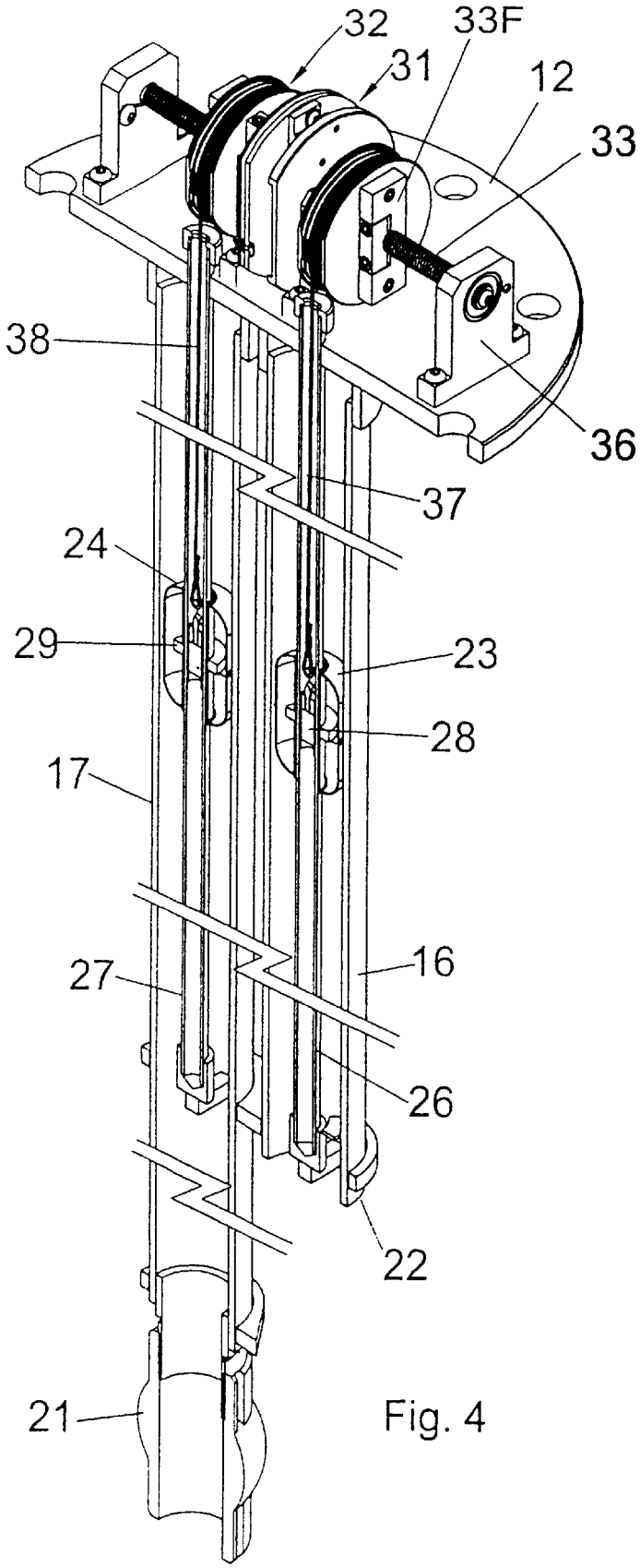
FIG. 4 is a cutaway perspective section taken at line 4—4 in FIG. 1 and omitting interior details of a ball valve.
Figure 5:
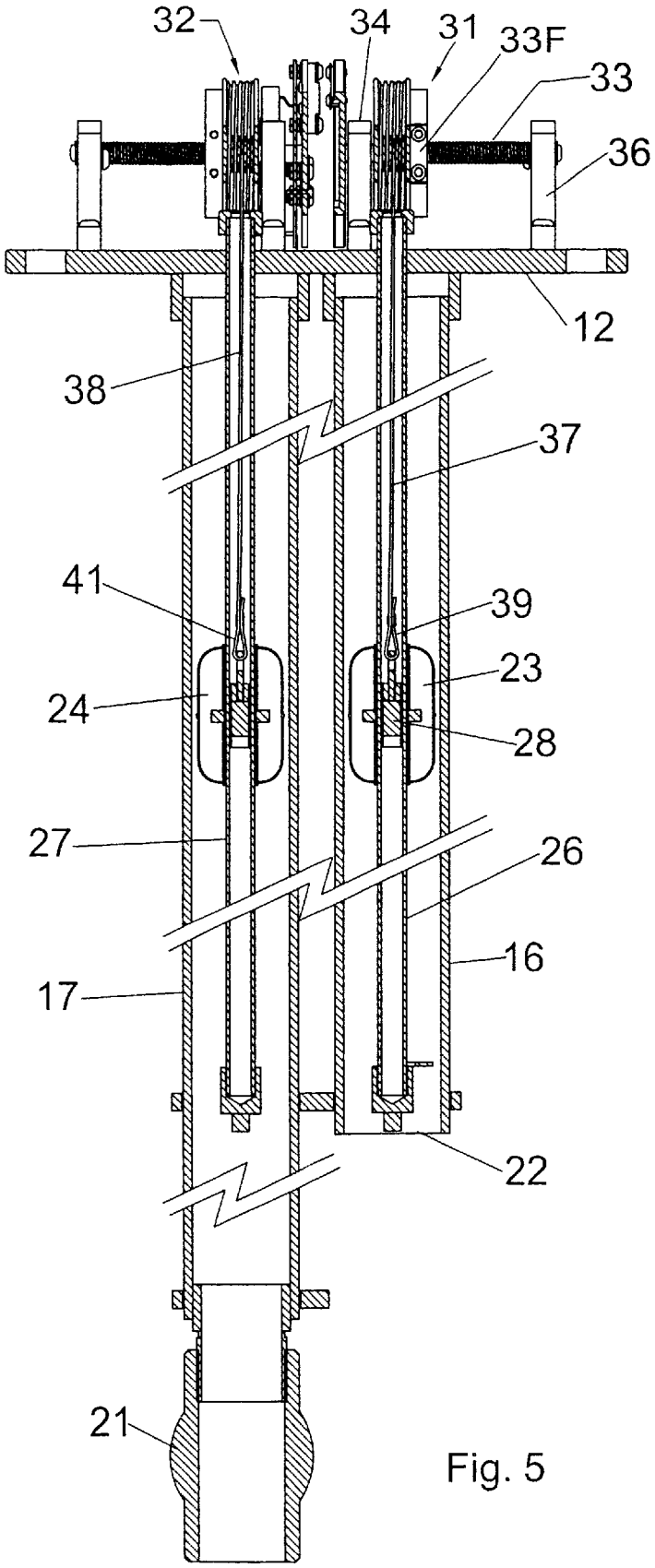
FIG. 5 is a vertical section also taken at line 4—4 in FIG. 1.
Figure 6:
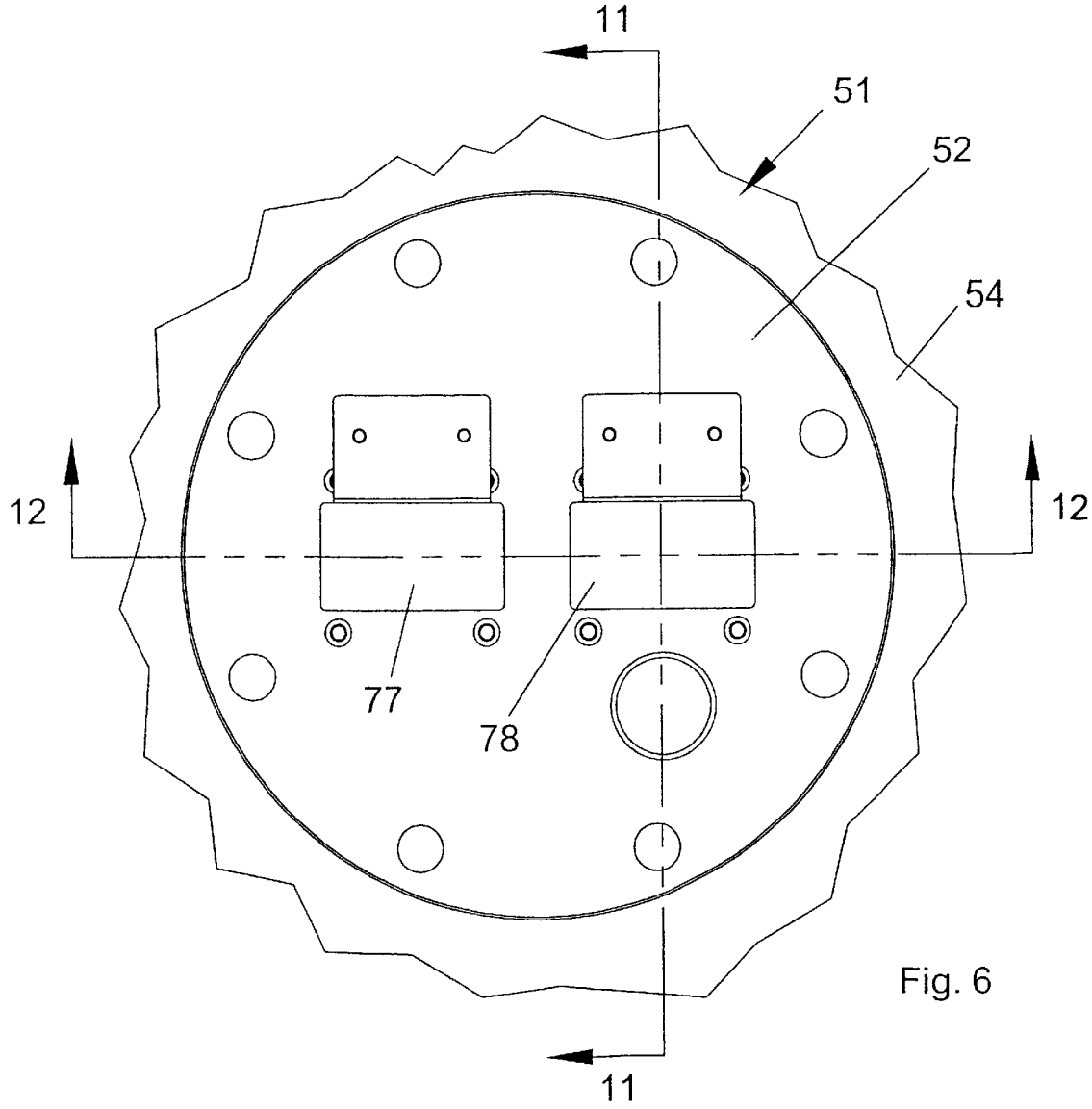
FIG. 6 is a top plan view of a hatch cover according to a second embodiment of the invention and located atop a cargo hold (shown fragmentarily) of a vessel.

For the purposes of promoting an understanding of the principles of the invention, reference will now be made to the embodiments illustrated in the drawings, and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, portions are omitted at the break lines in FIGS. 2–5 and 7–12 and 14 to conserve vertical space in the drawings. Referring particularly to the embodiment shown in FIGS. 1–5, gauge assembly 11 is mounted to a hatch cover plate 12 atop an access port flange 13 of a cargo hold 14 of a vessel. Two parallel pipes 16 and 17 are connected to the plate 12 and extend downwardly from it. One of the pipes 17 extends to a point near the bottom 18 of the hold, and a ball valve 19 is located at the lower end 21 of the pipe. The other pipe 16 extends down to a level near to, but above, the level of the valve assembly. The lower end 22 of the second pipe is open.

Two floats 23 and 24 are provided, one in each of the pipes. Each float surrounds a guide tube 26 and 27 inside the pipe and which extends down from the plate 12 and serves as a guide for the float as it moves up or down in response to a change of level of cargo in the hold.

A float follower 28 and 29 is received inside each tube and moves with the float in response to magnetic coupling with a magnet in the float.

Two reels 31 and 32 are mounted (as on a shaft mounted on pillow blocks 34 and 36 for reel 31, for example) for free rotation above the plate 12. Each reel stores a filament or cable 37, 38 having an end connected to the top of a float follower as at 39, 41. The reels are provided with take-up springs to avoid slack in the line from the reel to the float, but the spring tension is modest and adjustable so that the floats in both pipes, when valve 19 is open, will respond identically to a change in cargo level. In the illustrated example, a coil spring is mounted concentrically on a reel mounting shaft, such as spring 33 for the shaft mounting reel 31. One end of the spring 33 is anchored at pillow block screw 36S (FIG. 1). The other end is clamped to the outboard face of reel 31 at 33F.

The reels have a combination of proximity switches, such as a magnetic reed switch 42 on reel 32 and switch actuator magnet 43 on the other reel 31, so that if there is a difference in float height, the officer in charge of the cargo can be alerted accordingly. Electrical conductors run from the switch 42 to the terminal block 46, to which monitoring or alarm equipment can be connected.

The sensing of any difference of float height is enabled by having the valve 19 at the bottom of the one pipe. It is open when the hold is loaded with cargo. Thus, both pipes will be filled with cargo to the height 47 (FIG. 2) of the cargo in the hold when it is filled. Then the valve 19 is closed by a handle 48 at the top, operating through mating gears 49, 51 to close the valve. Then, as long as there is no loss of cargo, both floats will remain at the same height in the two pipes, regardless of changes of temperature of cargo, since both pipes are immediately adjacent each other and submerged in the same cargo. In addition, because of the length of the open pipe 16 so that cargo access into it, whether in the wall or at the bottom end as shown, is at a substantial depth in the cargo hold, it is not susceptible to wave action.

It should be understood that a goal of this arrangement is to be able to detect cargo losses which are a small percentage of the original quantity stored in the hold. Accordingly, with equal weights of floats, float followers, follower tethering line 37, 38, and tensioning on the reels, and calibration of the reed switch or other sensors employed between the two reels, the change of float height can be related to the total cargo quantity to provide detection and an alarm, if a loss occurs in excess of a percentage of the total fill volume predetermined to be a maximum tolerable.

Referring now to the embodiment of FIGS. 6–12, the gauge assembly 51 is mounted to hatch cover plate 52 atop an access port flange 53 (FIG. 12) of a cargo hold 54 of a vessel. The cover plate may be mounted to the flange in any suitable means. A series of circularly spaced holes for bolts is shown as an example.

Two parallel pipes 56 and 57 are mounted to the plate 52 and extend downwardly from it. One of the pipes 56 has a lower end 58 to which is fixed and sealed, a control valve seat assembly 59. It includes a mounting ring 59M and a valve seat plate 59S fixed and sealed to the ring 59M and which has a lower surface 61 near the bottom 62 of the cargo hold 54. The lower end 63 of pipe 57 is open. Guide tubes 64 and 66 secured in plate 52 extend downward through the plate and concentric with the pipes 57 and 56, respectively. Floats 67 and 68 received in pipes 57 and 56, respectively, encircle the guide tubes 64 and 66, respectively, and are movable axially along them. Each of the floats has a magnet ring in it such as 69 in 67 and 71 in 68. Float follower magnets 72 and 73 are within the tubes 64 and 66, respectively, and move with its respective float in response to magnetic coupling with the magnet in the float. The tops 74 and 76 of the float followers 72 and 73, respectively, are reflective surfaces to reflect impulses from lasers 77 and 78 mounted atop the cover plate 52. As in the FIGS. 1–5 embodiment, the lower ends of the guide tubes 64 and 66 of this second embodiment are received in stabilizing bridges 79 and 81, respectively, spanning the interior of the pipes 57 and 56, respectively, across their diameters.

Figure 13:
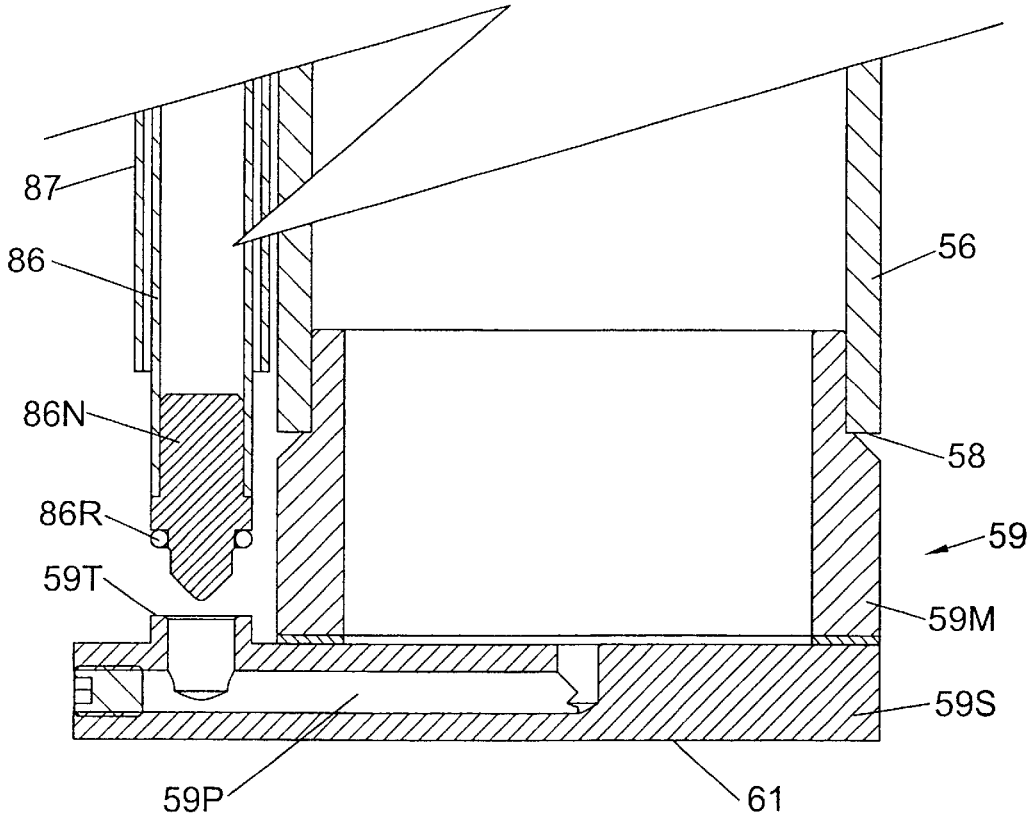
FIG. 13 is an enlarged sectional view showing details of the control valve.
Figure 14:
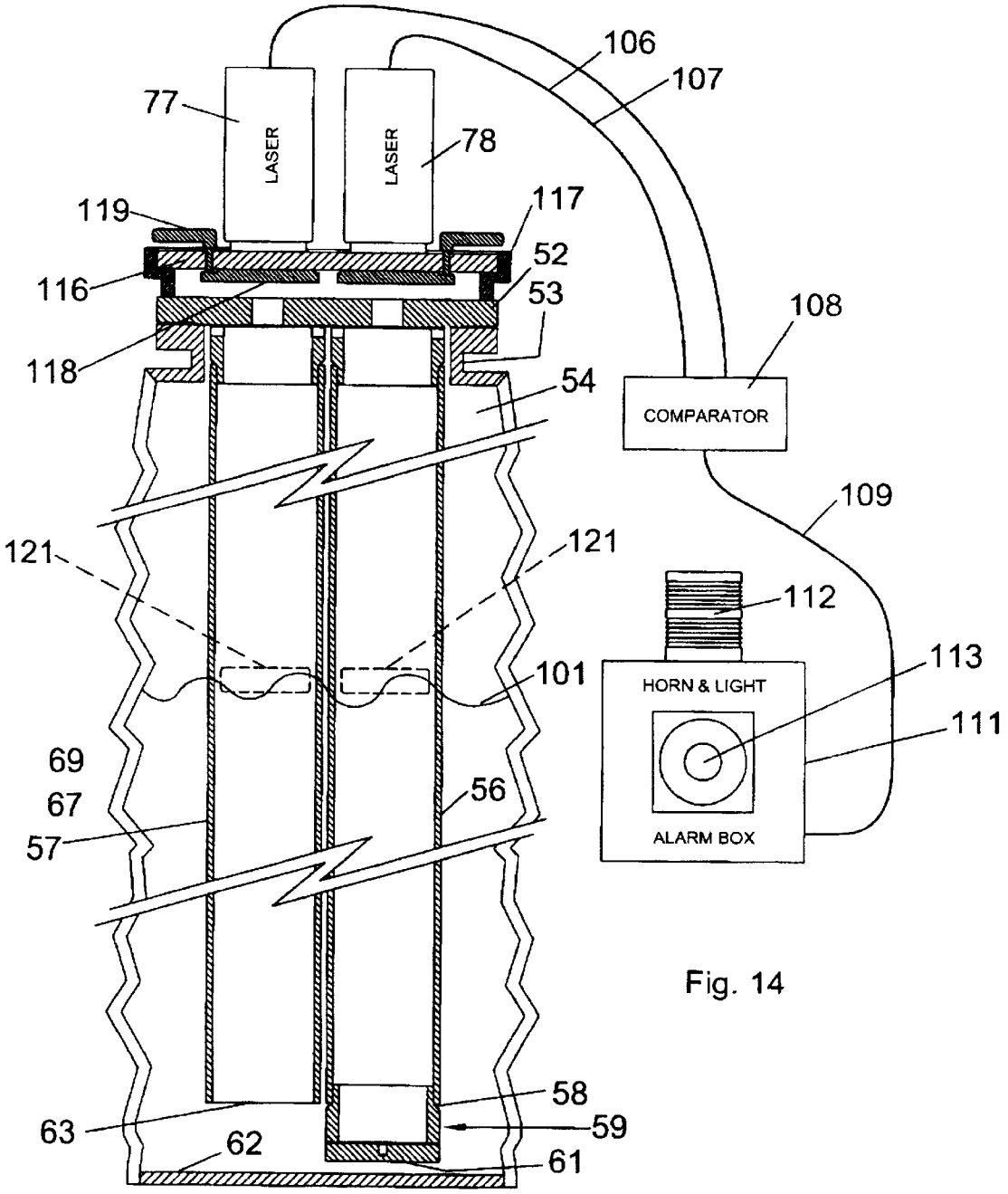
FIG. 14 is a view similar to FIG. 12 but showing a third embodiment of the invention.

As shown best in FIG. 13, the control valve seat assembly 59 includes a mounting ring 59M which is received and sealed in the lower end of the pipe 56. The lower end of the mounting portion is sealed and seated to the seat plate 59S which has an upwardly opening valve seat 59T. A passageway 59P communicates from the opening encircled by the valve seat to a central opening under the float 68 in pipe 56.

A valve plunger rod shown as a tube 86 has a plug 86N at its lower end. The plug has a tapered tip to center it in the seat 59T. A sealing member in the form of O-ring 86R (FIG. 13) is received and retained on a shoulder above the tip of plug 86N.

Figure 7:
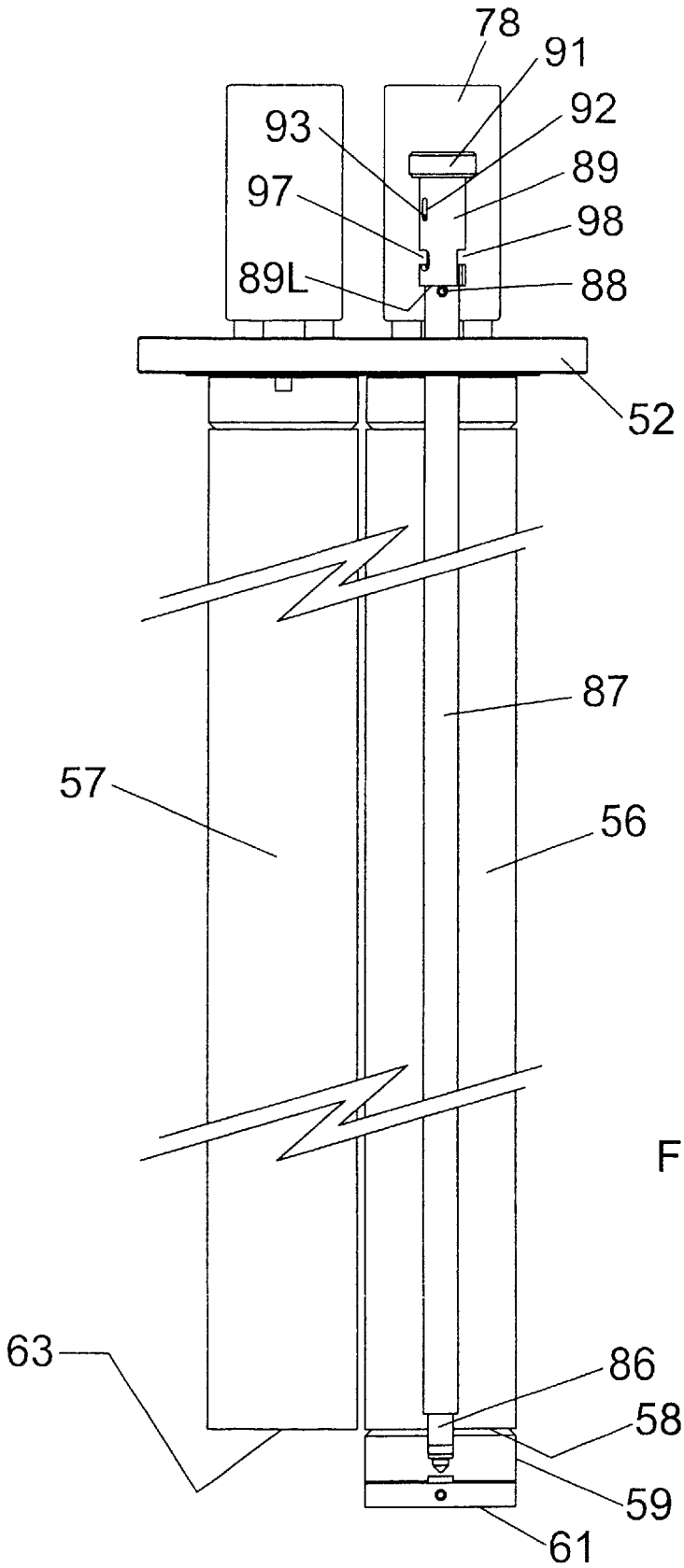
FIG. 7 is a front view thereof with a control valve open and portions of the overall height of the assembly broken out to conserve space in the drawing as is done in the rest of the views.
Figure 8:
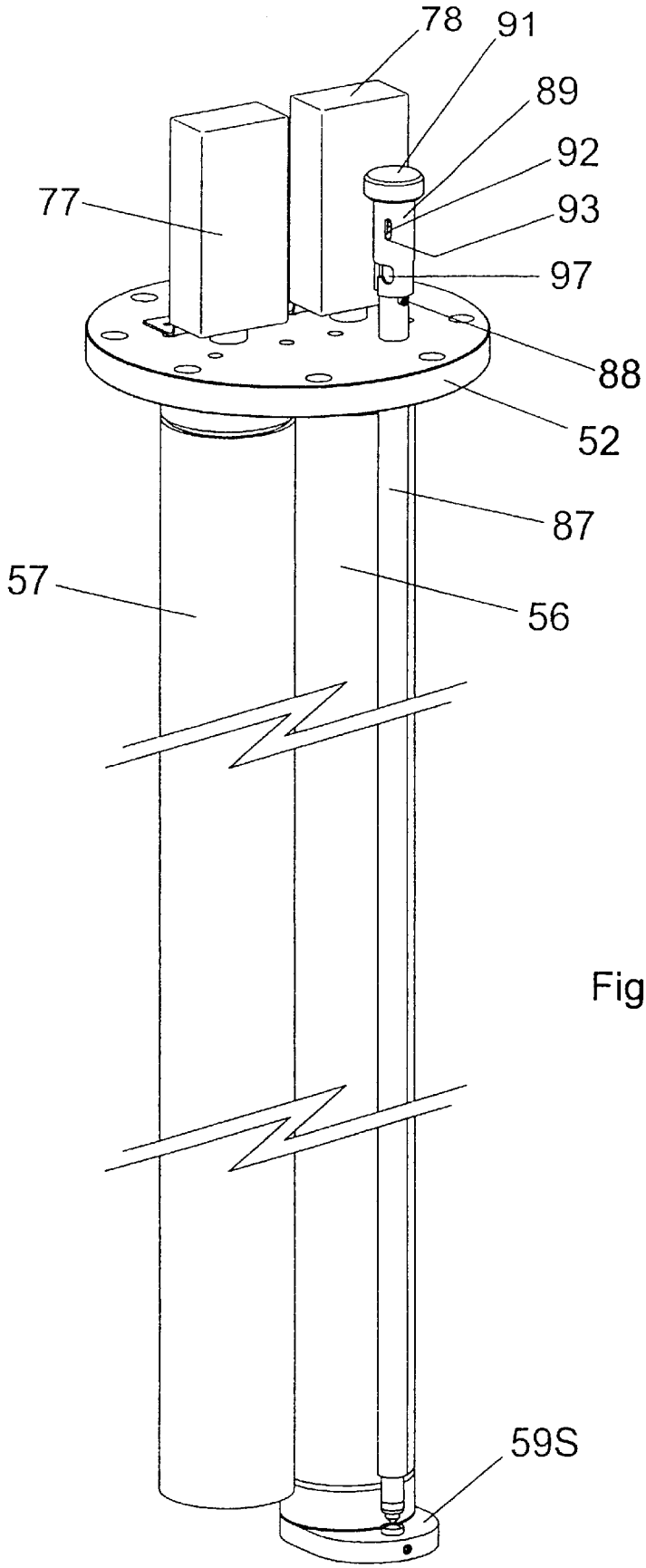
FIG. 8 is a frontal isometric view thereof with the control valve open.
Figure 9:
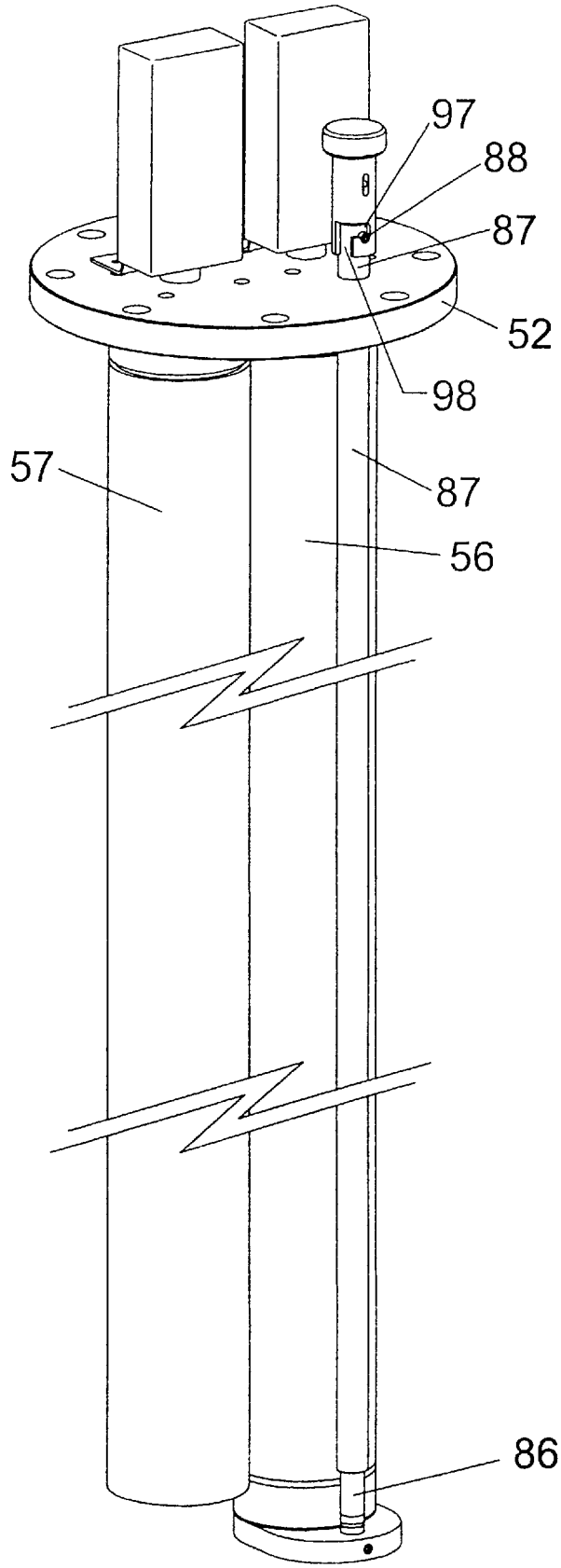
FIG. 9 is an isometric view thereof with the control valve closed.
Figure 10:
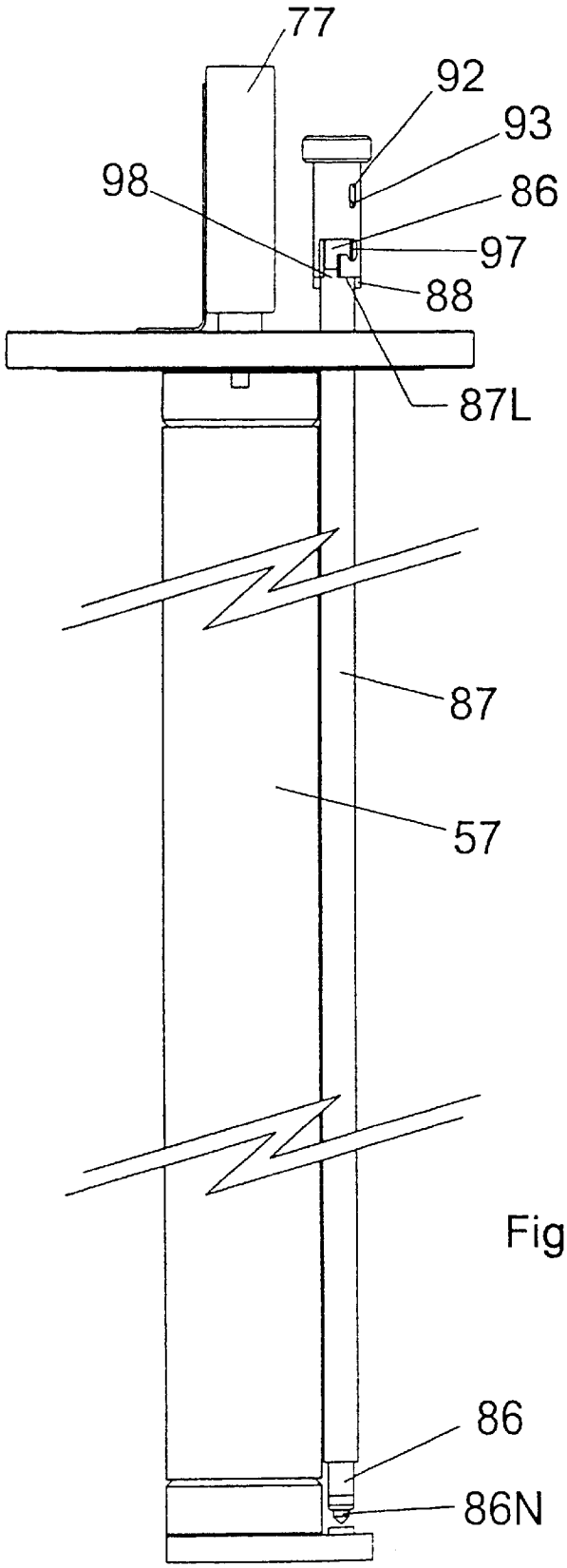
FIG. 10 is a left-side elevational view thereof with the control valve open.
Figure 11A:
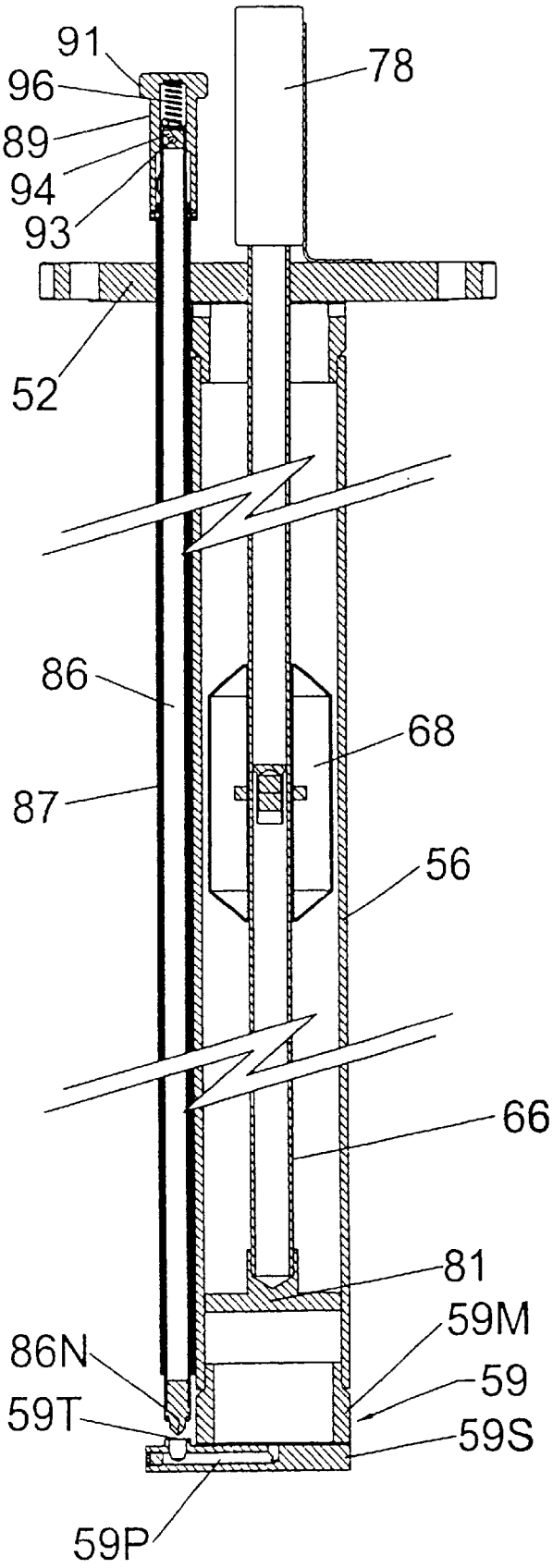
FIG. 11A is a section therethrough with the valve open taken at line 11—11 in FIG. 6 and viewed in the direction of the arrows.
Figure 11B:
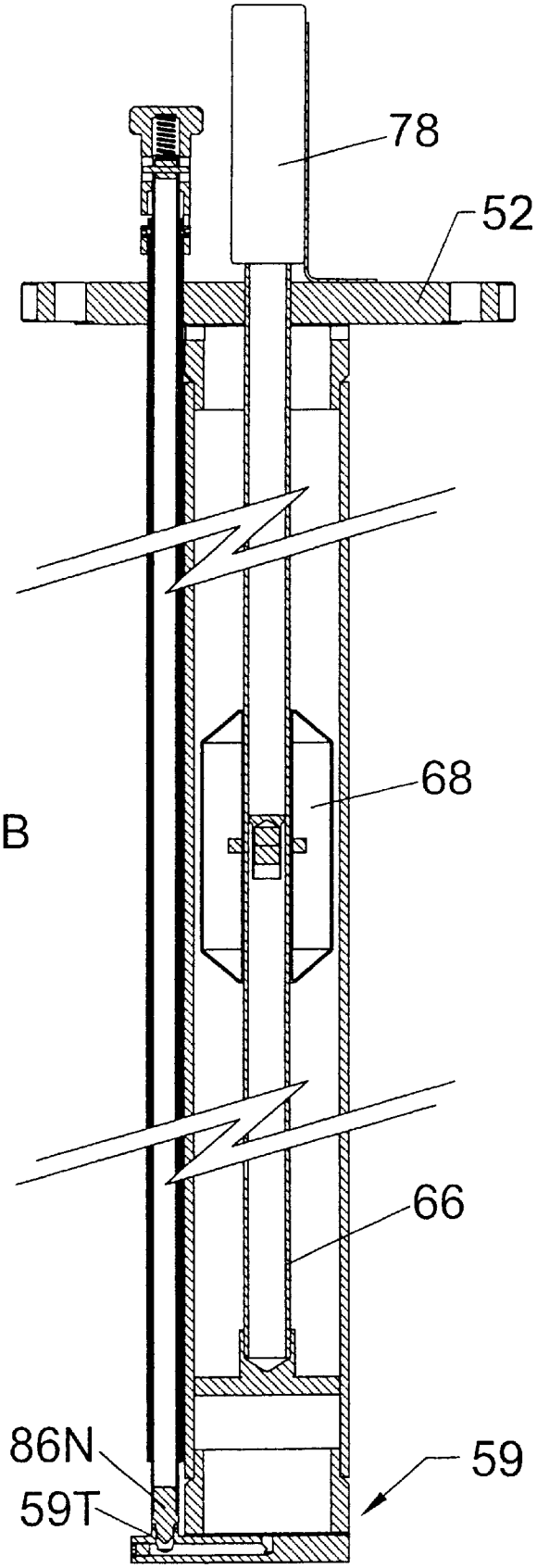
FIG. 11B is a view like FIG. 11A but with the valve closed.

The rod 86 is slidably received in tube 87, which is secured to the pipe 56 and projects upward through and is affixed to plate 52. Tube 87 has a pin 88 projecting laterally from it. Referring specifically to FIGS. 7 and 8, a sleeve 89 with knob 91 at its top has a slot 92 in it receiving a pin 93 projecting laterally from the block 94 (FIG. 11A) fixed to the top of the plunger rod 86. A spring 96 is captured between the underside of the knob 91 and the top of block 94. The sleeve 89 has a bayonet slot with latch portion 97 shown on one side of the sleeve in FIG. 7 and the rest of it shown at 98 in FIG. 7. Therefore, when this sleeve is in the position shown in FIG. 7, the lower end 89L of the sleeve is engaged with pin 88, holding the sleeve up resting on pin 88, at which time the pin 93 in block 94 is held up, thus holding up the rod 86 and thereby holding O-ring 86R up off the seat 59T in the valve seat plate 59S. To close the valve, the knob 91 is turned clockwise or counterclockwise about its axis, enabling the slot portion 98 to pass the pin 88. The knob 91 is then pushed downward manually, whereby the spring 96 urges the rod 86 downward to engage the O-ring 86R with the seat 59T and close the valve. The knob can be pushed further downward until the lower end of the hook portion 97 of the slot in the sleeve can engage pin 88 as shown in FIG. 9 and retain the O-ring engaged with the seat under the urging of the spring 96. The valve can be opened thereafter by simply reversing the procedure, pushing the knob 91 down and turning the sleeve 89 to release the notch 97 from pin 88 and allow the engagement of slot 92 with pin 93 to raise the rod 86 and then further turning of the sleeve 89 to again seat the lower edge 89 thereof on the pin 88 in the tube 87. If it is ever necessary to replace the O-ring, the rod 86 can be pulled completely out of tube 87 by simply pulling up on knob 91.

For utility on containers which carry flammable liquids, and to avoid the possibility of sparks, the above described embodiments isolate the cargo from the electrical components of the equipment. This is done by using the tubes internal to the pipes, and the float followers within the tubes. It is believed that a broad aspect of the invention can be practiced in a simpler form requiring fewer parts, when the measuring sensors are lasers with the capability to perform accurately while sending the laser signal through glass. In this embodiment, shown schematically in FIG. 14, the floats and tubes inside the pipes may be omitted. A window 116 in frame 117 is mounted atop and sealed to the cover plate 52, around a suitably sized opening in the plate, container. The lasers 77 and 78 are mounted on top of or above the window and oriented for the beams direct to the surface of the liquid in the pipes. If there is any doubt that the reflection from certain types of cargo liquid back to the laser would be of sufficient strength or clarity, and to provide universal utility of the apparatus, it may be equipped with a float in each of the pipes to receive and reflect the beam back to the laser. This is represented by the dotted lines 121 in FIG. 14. Also, to preclude any concern about clouding or otherwise obscuring clarity of the lower surface of the window, the window may be a sight glass with wiper 118 and operating handle 119 such as disclosed in my U.S. Pat. No. 5,284,105, or some other means may be used to deal with such problem. A separate window may be used for each laser to pipe combination, but it is believed that a single window as shown will be more convenient.

If the lasers preferred for use with the latter two embodiments of the invention would be inconvenient to mount precisely as shown, mirror arrangements may be used to direct the beams down the tubes or pipes. Also, although the orientation of the pipes and tubes in the various embodiments is preferably vertical and in parallel relation, it is possible that some variations from vertical and/or from parallelism may be made and remain within the scope of the present invention.

Operation

Figure 12:
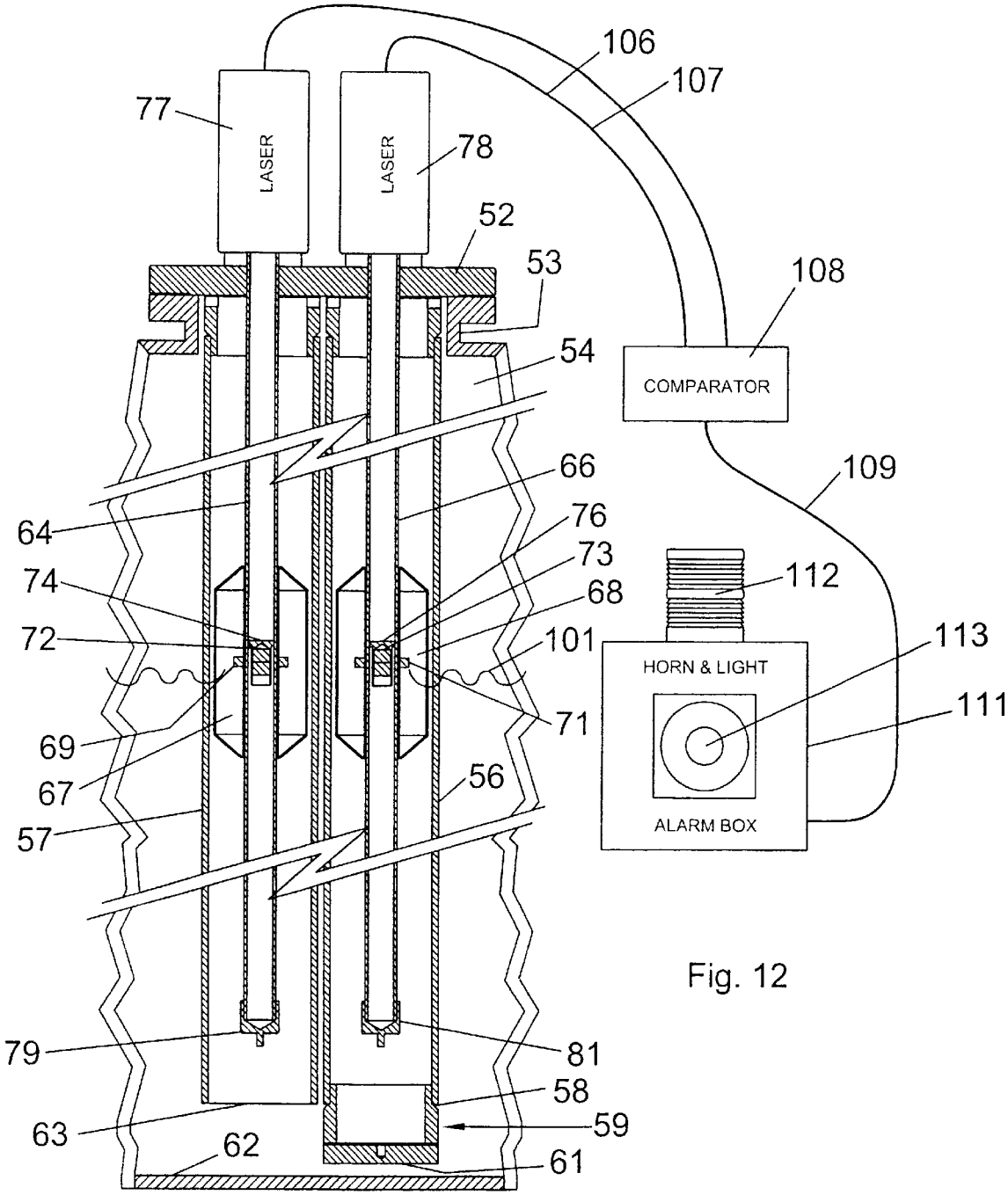
FIG. 12 is a sectional view thereof taken at line 12—12 in FIG. 6 and viewed in the direction of the arrows and showing, schematically, some additional components.

For purposes of example, it will be assumed that the cargo hold is filled to a level designated 101 in FIG. 12. Regardless of where that is in the hold, and what percentage of hold capacity it represents, the intent is to be alerted in the event of any loss of cargo from the hold during the passage of time. For that purpose, while the cargo hold is filled, the bottom of pipe 57 is open and the float can rise freely. The valve assembly on pipe 56 must be open to admit cargo to that pipe as well. Thus, when the level of cargo has stabilized in the cargo hold, both floats will be at the same level. Then the valve is manually shut and remains so until the cargo has reached it intended destination. Meanwhile, periodically during transit of the cargo from its shipment site toward its destination, the laser units 77 and 78 are activated. They transmit pulses down the respective tubes 64 and 66 and receive the reflected signals from the tops of the float followers. It should be understood, of course, that the laser assemblies 77 and 78 also include the receivers as well as transmitters. Receiver outputs on cables 106 and 107 are fed to an electronic comparator 108. As the lasers are identical and transmit pulses at reasonably close intervals, the distances indicated by the time from transmission to the time of reception of a reflected signal should be the same from both lasers. If they are not both representative of the same elapsed time from transmission to reception in both lasers, it is an indication of loss of cargo. Consequently, an alarm output is transmitted on cable 109 to an alarm assembly 111 which may include a light 112 and horn 113. Of course, other signals from comparator 108 may be made to various locations for attention by those responsible for security of the cargo. One possible example of a usable laser is the Trimble® brand Spectra Precision Laser HD360.

It should be understood that all embodiments of the present invention can be used in containers other than cargo holds of vessels such as tanker ships and barges. Just a few examples are tanker trucks, railroad tanker cars and storage tanks. Also, although a comparator of float positions is achieved with the magnet and reed switch 43 and 42, respectively, in the first embodiment, and comparison of levels is achieved with the electronic signal comparator 108 in the second and third embodiments, optical, ultrasonic or other comparators might also be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow.

The invention claimed is:

1. Cargo loss detection apparatus for a liquid cargo container and comprising:

first and second parallel vertical pipes, the first pipe having a lower end adapted for submersion in liquid cargo in the container, and said first pipe having a valve which can be opened to admit cargo from the container into the first pipe for movement of a portion of the cargo upward in the first pipe to the level of the surface of the cargo around the first pipe outside of the pipe, and the valve being operable when actuated to close to prevent movement of cargo out of the first pipe when the level of the surface of the cargo around the first pipe decreases, the second pipe having a lower end adapted for submersion in the said liquid cargo in the container and the second pipe being adapted to admit a portion of the cargo to flow upward into said second pipe to the said level of the surface of the cargo around the first pipe;

a first float in said first pipe and having a first magnet;

a second float in said second pipe and having a second magnet;

first and second parallel vertical tubes received through said first and second floats, respectively, each of said floats being floatable on the portion of the cargo in the pipe in which the float is located, and each float being movable lengthwise of the said tube received through the float;

first and second float followers located in said first and second tubes and movable lengthwise in said first and second tubes, respectively;

third and fourth magnets connected to said first and second float followers, respectively, and magnetically suspended by said first and second magnets, respectively, whereby said float followers are suspended in their respective tubes by said floats;

first and second float follower level recognition devices atop said first and second tubes, respectively, to establish a float relationship reference when both floats have reached a stabilized relationship in cargo admitted to the same level in both pipes, and to sense a variation from said relationship reference in response to a change from said stabilized relationship when cargo has been lost from said container; and a comparator coupled to said recognition devices and responsive to a sensed variation from said relationship reference.

2. The apparatus of claim 1 and wherein:

said recognition devices comprise lasers having output coupled to said comparator.

3. The apparatus of claim 1 and wherein:

said recognition devices comprise ultrasonic devices having outputs coupled to said comparator.

4. The apparatus of claim 1 and wherein:

said recognition devices comprise reels storing filaments connected to said float followers.

5. The apparatus of claim 4 and wherein:

said comparator comprises a magnet coupled to one of said reels and a magnetically-operated switch coupled to another of said reels.

6. The apparatus of claim 1 and further comprising:

a valve actuator extending in a direction away from said valve toward at least one of said float follower level recognition devices and having a valve mover force input member thereon adjacent one of said float follower level recognition devices;

said valve having a movable sealing member coupled to said actuator, and said valve having a stationary sealing member including a port communicating with the interior of said first pipe, said actuator being operable, when actuated to establish cooperation of said movable and stationary sealing members to terminate communication between cargo in said first pipe and cargo around the outside of said first pipe.

7. The apparatus of claim 6 and wherein:

said valve is a ball valve with a valve body connected to the lower end of the first tube and having the stationary sealing member therein and having the movable sealing member with a shaft extending laterally of said first pipe and geared to and end of said actuator remote from said force input member.

8. The apparatus of claim 7 and wherein:

said actuator includes a shaft extending parallel to said first pipe and having a gear at one end and wherein the force input member is a handle at the other end.

9. The apparatus of claim 6 and wherein:

said stationary sealing member includes a plate secured and sealed to the lower end of said first pipe, said plate having a portion extending laterally from said first pipe and having an upwardly facing valve seat thereon, said plate having a passageway therein providing communication between said valve seat and the interior of said first pipe.

10. The apparatus of claim 1 and wherein:

said recognition devices are arranged to respond to a change in location of said second float follower relative to said first float follower lengthwise of said tubes.

11. The apparatus of claim 10 and wherein:

said recognition devices comprise lasers having outputs coupled to said comparator.

12. The apparatus of claim 10 and wherein:

said recognition devices comprise devices producing wireless signals and coupled to said comparator.

13. The apparatus of claim 10 and wherein:

said recognition devices comprise reels storing filaments coupled to said float followers; and said comparator comprises a magnet coupled to one of said reels and a magnetically operated switch coupled to another of said reels.

14. A liquid cargo container and loss detection combination comprising:

a cargo container having a top and at least one opening through the top for access downward into the interior of the container;

liquid cargo in said container;

first and second parallel vertical pipes projecting downward through said opening into said cargo, the first pipe having a lower end submerged in said liquid cargo in the container and having a valve which can be opened to admit cargo from the container into the first pipe for movement of a portion of the cargo upward in the first pipe to the level of the surface of the cargo around the outside of the first pipe, and the valve being operable when actuated to a closed condition to prevent movement of cargo out of the first pipe when the level of the surface of the cargo around the outside of the first pipe decreases, the second pipe having a lower end submerged in the said liquid cargo in the container and open to admit a portion of the cargo to flow upward into said second pipe to the said level of the surface of the cargo around the first pipe;

a first float in said first pipe and having a first magnet;

a second float in said second pipe and having a second magnet;

first and second parallel vertical tubes received through said first and second floats, respectively, each of said floats being floatable on the portion of the cargo in the pipe in which the float is located, and the float being movable lengthwise of the said tube received through the float;

first and second float followers located in said first and second tubes, respectively;

third and fourth magnets connected to said first and second float followers, respectively, and magnetically suspended by said first and second magnets, respectively, whereby said float followers are suspended in their respective tubes by said floats;

first and second float follower level recognition devices atop said first and second tubes, respectively, to first measure the distances of said first and second float followers from a reference level and thereby establish relationship reference between the measured distance of said first float follower and the measured distance of said second float follower; and a comparator coupled to said float follower level recognition devices and responsive to a change in said relationship reference.

15. The combination of claim 14 and wherein:

said recognition devices are arranged to respond to a change in location of said second float follower relative to said first float follower lengthwise of said tubes.

16. The combination of claim 14 and wherein:

the recognition devices comprise devices producing wireless signals and coupled to said comparator.

17. The combination of claim 16 and wherein:

said devices producing wireless signals are lasers.

18. The combination of claim 14 and wherein:

said recognition devices comprise reels storing filaments coupled to said float followers; and said comparator comprises a magnet coupled to one of said reels and a magnetically operated switch coupled to another of said reels.

19. The combination of claim 14 and further comprising:

a valve actuator extending in a direction away from said valve toward at least one of said float follower level recognition devices and having a valve mover force input member thereon adjacent one of said float follower level recognition devices;

said valve having a movable sealing member coupled to said actuator, and said valve having a stationary sealing member including a port communicating with the interior of said first pipe, said actuator being operable, when actuated to establish cooperation of said movable and stationary sealing members to terminate communication between cargo in said first pipe and cargo around the outside of said first pipe.

20. The combination of claim 19 and wherein:

said valve is a ball valve with a valve body connected to the lower end of the first tube and having the stationary sealing member therein and having the movable sealing member with a shaft extending laterally of said first pipe and geared to and end of said actuator remote from said force input member.

21. The combination of claim 20 and wherein:

said actuator includes a shaft extending parallel to said first pipe and having a gear at one end and wherein the force input member is a handle at the other end.

22. The combination of claim 19 and wherein:

said stationary sealing member includes a plate secured and sealed to the lower end of said first pipe, said plate having a portion extending laterally from said first pipe and having an upwardly facing valve seat thereon, said plate having a passageway therein providing communication between said valve seat and the interior of said first pipe.

23. The combination of claim 14 and wherein:

said recognition devices are reels storing filaments connected to said float followers, and said comparator comprises a magnet on one reel and a magnet-responsive switch on the other reel.

24. The combination of claim 14 and wherein:

said recognition devices comprise lasers coupled to said comparator.

25. The combination of claim 24 and wherein:

said comparator is electronic.

26. The combination of claim 25 and further comprising:

an alarm coupled to said comparator.

27. In a transportation container holding a cargo of liquid, apparatus for detecting loss of some of said liquid from said container and comprising:

first and second pipes in said container, each pipe having upper and lower portions, said lower portions being submerged in said liquid in said container and each pipe having at least one submerged opening in said lower portion providing admission of said liquid from said container through said openings into said pipes to an original level which is the same in both pipes as the level of the said liquid in said container outside said pipes;

said first pipe having at least one valve communicating with said submerged opening in said first pipe lower portion and operable when closed to prevent communication between said liquid in said first pipe and said liquid in said container outside said first pipe after admission of said liquid into said first pipe to said original level; and means for detection of a difference between the level of admitted liquid in said first pipe and the level of admitted liquid in said second pipe after closure of said valve.

28. The apparatus of claim 27 and wherein:

said means for detection are lasers.

29. The apparatus of claim 28 and further comprising:

at least one window between said lasers and said pipes and enabling passage of radiation from said lasers to the surfaces of said admitted liquids in said pipes.

30. The apparatus of claim 29 and wherein:

said window has a top surface and a bottom surface and means for clearing said bottom surface.

31. The apparatus of claim 30 and wherein:

said means for clearing comprise a wiper engaging said bottom surface.

32. The apparatus of claim 27 and further comprising:

a first float located inside said first pipe and a second float located inside said second pipe, said floats normally floating on said liquid admitted into said pipes, and said second float having a normal elevational relationship to said first float when the level of admitted liquid in said first and second pipes is the same; and means for detection of a change from said normal elevational relationship of said second float to said first float to a different elevational relationship of said second float to said first float after closure of said valve.

33. The apparatus of claim 32 and wherein:

said means for detection are lasers.

34. A method for detection of leakage of liquid from a container during a period of time between a start time and a test time and comprising:

providing first and second pipes in said container with lower portions of said pipes submerged in liquid in the container;

admitting said liquid into said pipes to a level in both pipes substantially equal to the level of said liquid in said container outside said pipes;

at said start time, disabling communication between said admitted liquid in said first pipe and said liquid in said container;

at said test time, measuring the level of the surface of said admitted liquid in said first pipe and the level of said admitted liquid in said second pipe; and making a comparison of said measurements of said levels to detect loss of liquid from said second pipe.

35. The method of claim 34 and further comprising:

using lasers to do said measuring.

36. The method of claim 35 and further comprising:

directing radiation beams from said lasers onto the surfaces of said admitted liquid in said pipes, and using laser energy reflected from said surfaces of admitted liquid to do said measuring.

37. The method of claim 35 and further comprising:

providing floats in said pipes; and directing radiation beams from said lasers onto said floats, and using laser energy reflected from said floats to do said measuring.

38. The method of claim 35 and further comprising:

providing floats in said pipes;

providing guide tubes for said floats inside said pipes;

providing float followers inside said tubes and magnetically coupling said followers to said floats; and directing radiation beams from said lasers onto said float followers, and using laser energy reflected from said float followers to do said measuring.

39. The method of claim 34 and wherein:

said disabling of communication is done by closing a valve on said first pipe.

40. The method of claim 35 and further comprising:

directing beams from said lasers downward into said pipes through at least one window.

41. The method of claim 40 and further comprising:

clearing a lower surface of said window with a wiper; and operating said wiper from a location which is outside said container and outside a space between said window and said pipes.

42. The method of claim 34 and further comprising:

using the comparison to activate a device.

* * * * *